US012590773B2

(12) United States Patent
Taylor et al.

(10) Patent No.: US 12,590,773 B2
(45) Date of Patent: Mar. 31, 2026

(54) MAGAZINE DISCONNECT MECHANISM

(71) Applicant: Sig Sauer, Inc., Newington, NH (US)

(72) Inventors: Liam E. Taylor, Barrington, NH (US); Sean P. Toner, Merrimack, NH (US); Derek A. Oaks, Manchester, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 18/890,873

(22) Filed: Sep. 20, 2024

(65) Prior Publication Data

US 2025/0102256 A1 Mar. 27, 2025

Related U.S. Application Data

(60) Provisional application No. 63/584,646, filed on Sep. 22, 2023.

(51) Int. Cl.
*F41A 17/36* (2006.01)

(52) U.S. Cl.
CPC ..... *F41A 17/36* (2013.01)

(58) Field of Classification Search
CPC ..... F41A 17/34; F41A 17/36
See application file for complete search history.

(56) References Cited

U.S. PATENT DOCUMENTS 1,389,944 A * 9/1921 Garrison ..... F41A 17/36 89/137
3,715,826 A * 2/1973 Seifried ..... F41A 17/36 89/137
4,016,669 A * 4/1977 Gminder ..... F41A 17/36 42/70.02
4,291,481 A * 9/1981 Hillberg ..... F41A 17/36 42/70.02
5,293,708 A * 3/1994 Strayer ..... F41C 23/10 42/71.02
5,483,766 A * 1/1996 Hochstrate ..... F41C 23/10 42/71.02
6,234,059 B1 * 5/2001 Fuchs ..... F41A 19/15 89/196
6,457,271 B1 * 10/2002 Vaid ..... F41A 17/36 42/70.02
8,438,768 B2 * 5/2013 Kallio ..... F41A 17/46 42/70.02
12,305,942 B1 * 5/2025 Withey ..... F41A 17/36
(Continued)

FOREIGN PATENT DOCUMENTS

AT 519769 A4 * 10/2018 ..... F41A 17/48
DE 593956 C * 3/1934

*Primary Examiner* — Gabriel J. Klein
(74) *Attorney, Agent, or Firm* — Finch & Maloney PLLC

(57) ABSTRACT

A firearm has a magazine disconnect mechanism. The firearm includes a trigger operable between a resting position and a pulled position. The magazine disconnect mechanism has a trigger block positioned between the trigger and a magazine well of the firearm, where the trigger block is movable between a blocking position and a non-blocking position. In the blocking position the trigger block obstructs moving the trigger to the pulled position. The trigger block occupies the non-blocking position when a magazine is installed in the magazine well, and the trigger block occupies the blocking position when the magazine is absent from the magazine well.

20 Claims, 16 Drawing Sheets

(56) References Cited

U.S. PATENT DOCUMENTS

| | | | | |
|---|---|---|---|---|
| 2002/0152660 | A1* | 10/2002 | Fluhr | F41A 17/36<br>42/70.02 |
| 2012/0174453 | A1* | 7/2012 | Kallio | F41A 17/46<br>42/70.02 |
| 2012/0291325 | A1* | 11/2012 | Carr | F41A 17/48<br>42/70.02 |
| 2025/0198716 | A1* | 6/2025 | Ye | F41A 17/38 |

* cited by examiner

MAGAZINE DISCONNECT MECHANISM

RELATED APPLICATIONS

This application claims the benefit under 35 U.S.C. § 119(e) of U.S. Provisional Patent Application No. 63/584,646 titled MAGAZINE DISCONNECT MECHANISM, and filed on Sep. 22, 2023, the contents of which are incorporated herein by reference in its entirety.

TECHNICAL FIELD

The present disclosure relates generally to handguns and more particularly to a magazine disconnect mechanism for a semiautomatic handgun.

BACKGROUND

Compact handguns, such as autoloading semiautomatic handguns utilize a removable magazine to hold ammunition. Even after removing the magazine, it is possible that a round may remain in the chamber. Prior to takedown for cleaning, safe handling practices require users to clear ammunition from the chamber by racking the slide to eject a round from the chamber, visually checking the chamber, and physically feeling inside the chamber to be sure no ammunition remains. Such practices are effective when followed every time; however, in some instances, the use may fail to follow these practices and an unintentional discharge can result.

SUMMARY

The present disclosure is directed to a magazine disconnect mechanism that disables firing the handgun by pulling the trigger when the magazine is removed. In one example embodiment, the mechanism includes a trigger block positioned between the trigger and the magazine well of the firearm, where the trigger block can occupy blocking and non-blocking positions. When a magazine is absent from the magazine well, a spring biases the block to the blocking position where it obstructs pulling the trigger to the pulled position. When a magazine is received in the magazine well, the trigger block occupies the non-blocking position, thereby enabling normal operation of the gun.

The magazine disconnect can be part of a handgun or long gun. For example, the magazine well is defined in a grip portion of a grip module of a modular handgun, is defined in a frame of a handgun, is defined in a grip portion of a rifle or shotgun, is defined by a grip that can be attached to or that is part of a housing of a firearm. Thus, the firearm can be one of many types of firearms having a grip portion that defines, at least in part, the magazine well. Principles of the magazine disconnect can be applied to other firearms, including those in which the magazine well is forward of the trigger and those in which the magazine well is defined in the receiver or other location.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1:
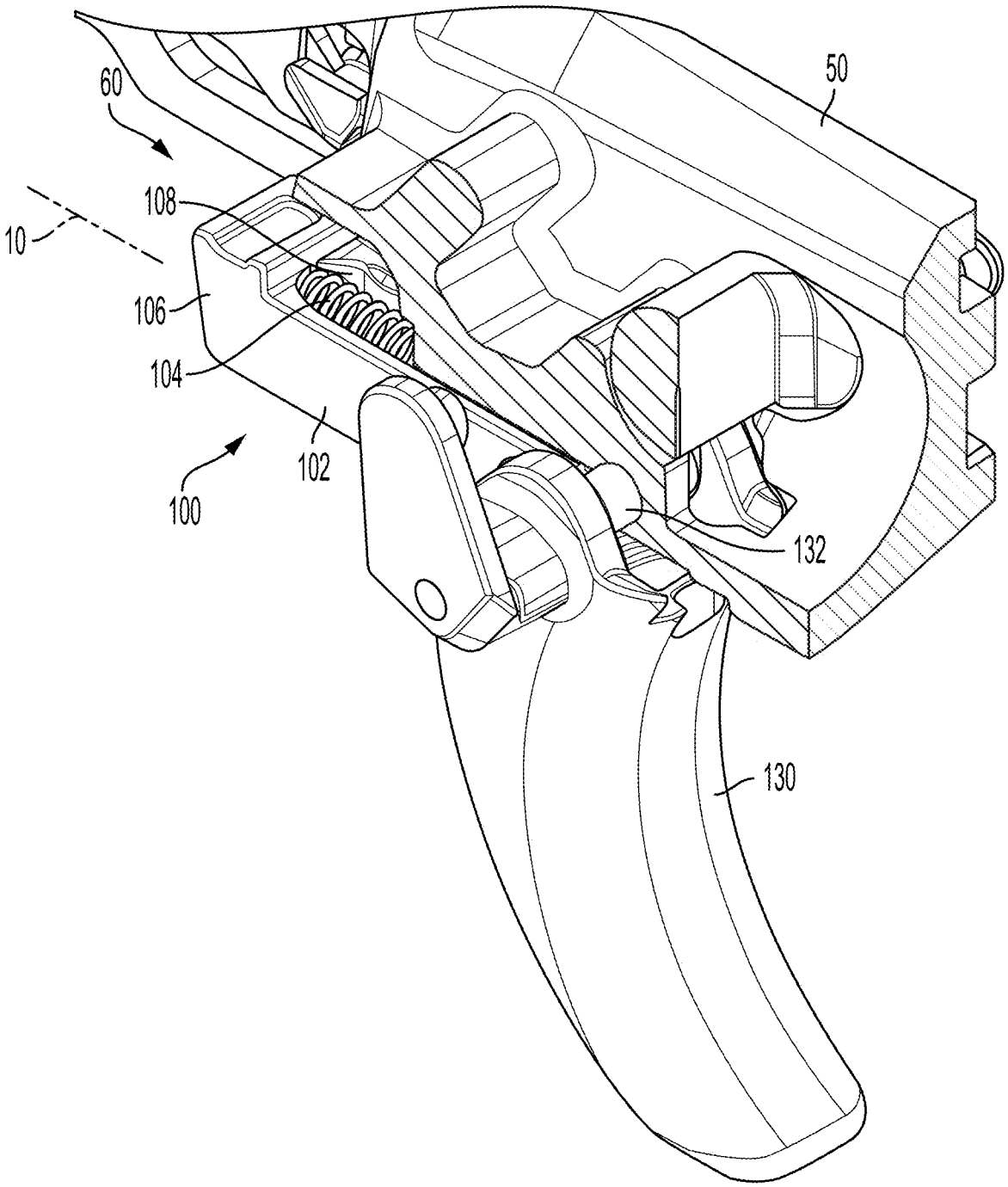
FIG. 1 is a top and front perspective view showing a trigger, a magazine disconnect mechanism, and part of a receiver, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed is a mechanism that prevents firing the gun when the magazine is removed from the magazine well. In accordance with one example embodiment, a trigger block is positioned between the trigger and the magazine well of the firearm. The trigger block can move longitudinally between a blocking position and a non-blocking position. A spring biases the trigger block towards a blocking position in which an end of the trigger block extends into the magazine well. When a magazine is installed in the magazine well, the magazine contacts the trigger block, causing it to shift to the non-blocking position and allowing the gun to be fired by pulling the trigger. In some embodiments, the magazine well is defined in a grip portion of the firearm, such as the grip portion of a handgun grip module, a grip portion of a handgun frame, or a grip portion of a long gun. In some embodiments, the magazine well is defined by the receiver or frame, such as in firearms where the magazine well is forward of the trigger.

Overview

For some semiautomatic handguns, the takedown procedure includes first removing the magazine, clearing the chamber of ammunition, and then pulling the trigger to decock the striker. If a round is inadvertently left in the chamber, pulling the trigger can fire the gun with dangerous or deadly consequences. Thus, a need exists for a mechanism that prevents firing the gun when the magazine is not present in the magazine well.

The present disclosure addresses this need and others by providing a firearm with a magazine disconnect mechanism. The firearm can be a semiautomatic handgun in some embodiments. When the magazine is not present in the magazine well, the disconnect mechanism occupies the blocking position, preventing firing the gun by pulling the trigger. On the other hand, when a magazine is installed in the magazine well, the disconnect mechanism occupies a non-blocking position, thereby enabling the gun to be fired by pulling the trigger.

As discussed herein, terms referencing direction, such as upward, downward, forward, rearward, left, right, front, back, etc., are used for convenience to describe a firearm and its components when the firearm is oriented in a traditional firing position with the barrel extending horizontally and the grip portion extending downward. Embodiments of the present disclosure are not limited by these directional references, and it is contemplated that a firearm and its components as described herein can be used in any orientation.

Also, it should be noted that, while generally referred to herein as a magazine disconnect mechanism for consistency and ease of understanding the present disclosure, the present disclosure is not limited to that terminology and the magazine disconnect mechanism alternately can be referred to as a magazine disconnect, a trigger-blocking mechanism, a trigger block, or other terms. Numerous configurations will be apparent in light of this disclosure.

EXAMPLE EMBODIMENTS

Figure 2:
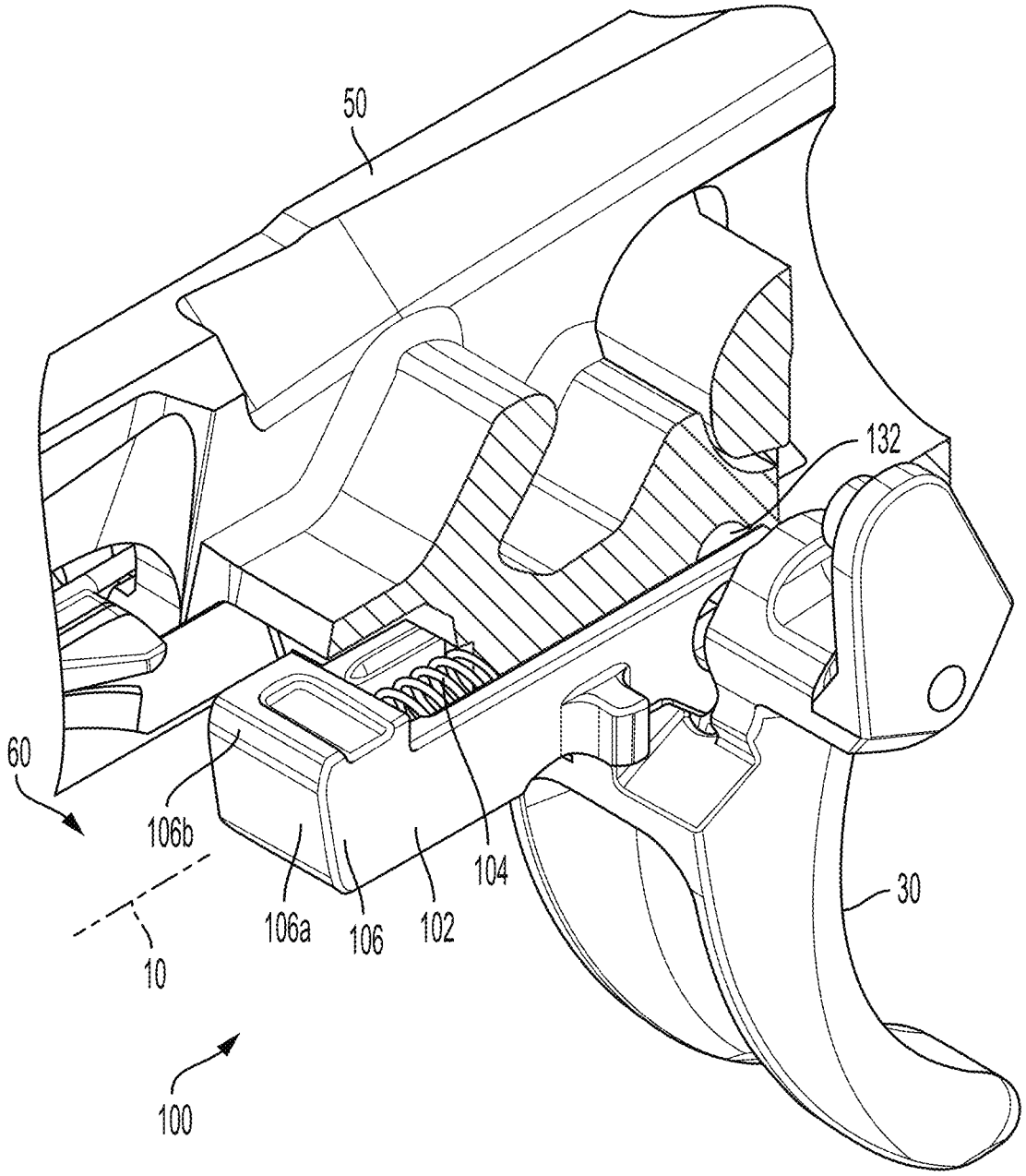
FIG. 2 is a top and rear perspective view showing the components of FIG. 1, in accordance with an embodiment of the present disclosure.

FIG. 1 is a top and front perspective view showing a trigger 130, a magazine disconnect mechanism 100, and part of a receiver 50, in accordance with an embodiment of the present disclosure. FIG. 2 is a top and rear perspective view showing these components. The trigger 130 is attached to the receiver 50 and can pivot about a trigger pin 132 between a resting position and a pulled position. The magazine disconnect mechanism 100 includes a trigger block 102 positioned between the trigger 130 and the magazine well 60, part of which is partially defined by the receiver 50. The trigger block 102 can move along a longitudinal axis 10 between a forward or non-blocking position and a rearward or blocking position. A spring 104 between the receiver 50 and the trigger block 102 biases the trigger block 102 towards the blocking position. In the example shown, the spring 104 is housed in a channel 108 defined in the trigger block 102.

Figure 11:
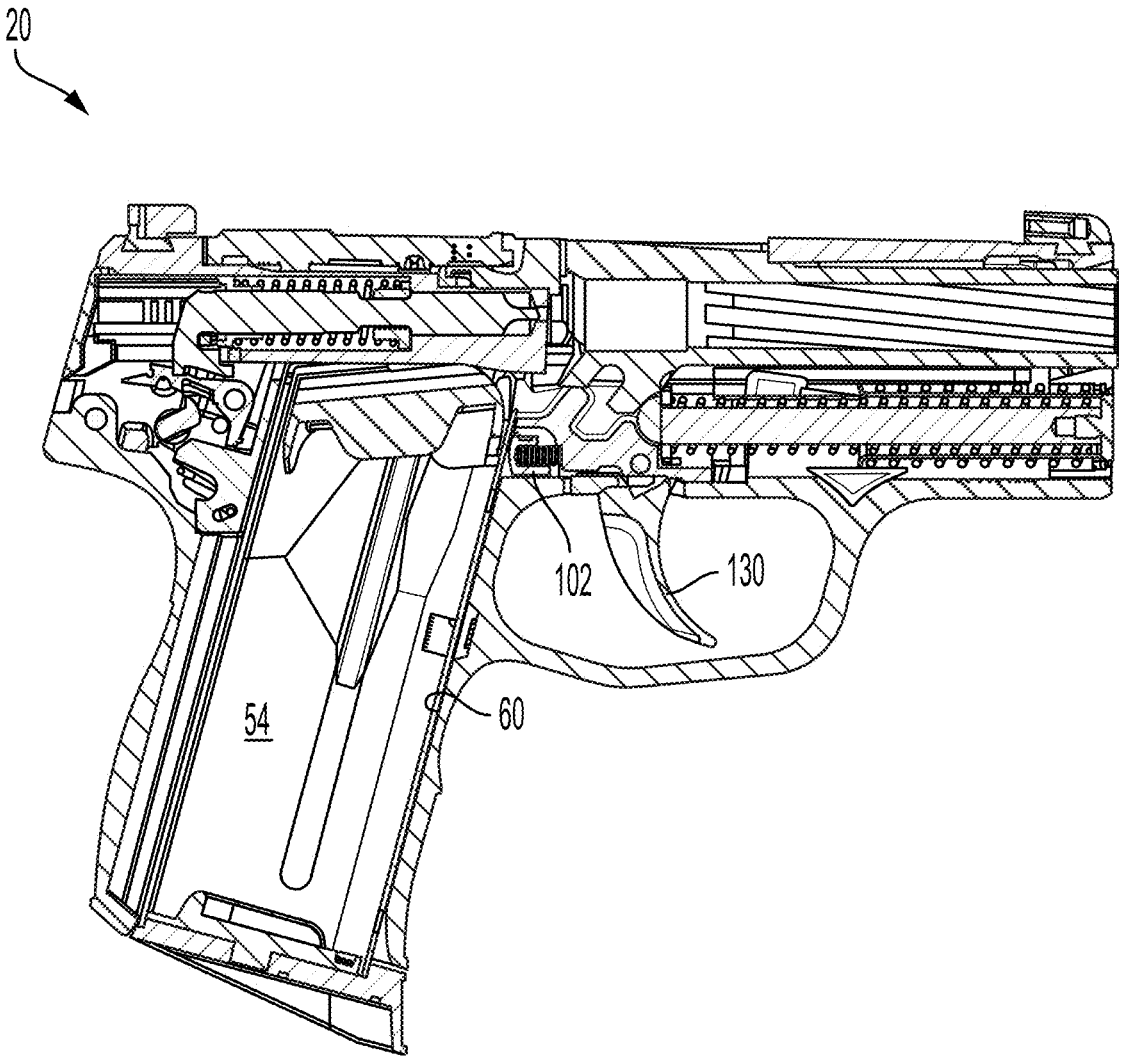
FIG. 11 illustrates a side view showing a longitudinal section of a handgun with a magazine disconnect mechanism, where the trigger is at rest and a magazine is installed in the magazine well, in accordance with an embodiment of the present disclosure.

As can be seen in FIG. 2, a rear end 106 of the trigger block 102 defines a first contact surface 106*a* configured to engage part of a magazine 54 (shown in FIGS. 11-12) as the magazine 54 is being installed. For example, the first contact surface 106*a* is sloped upward and rearward so as to cause the trigger block 102 to translate forward when contacted by the front wall of the magazine 54. In some embodiments, the rear end 106 also has a second contact surface 106*b* above the first contact surface 106*a*. The second contact surface 106*b* is oriented generally parallel to the magazine well. As such, the second contact surface 106*b* is configured to abut the magazine 54 when the magazine 54 is installed in the magazine well 60, such as shown in FIG. 11.

Figure 3:
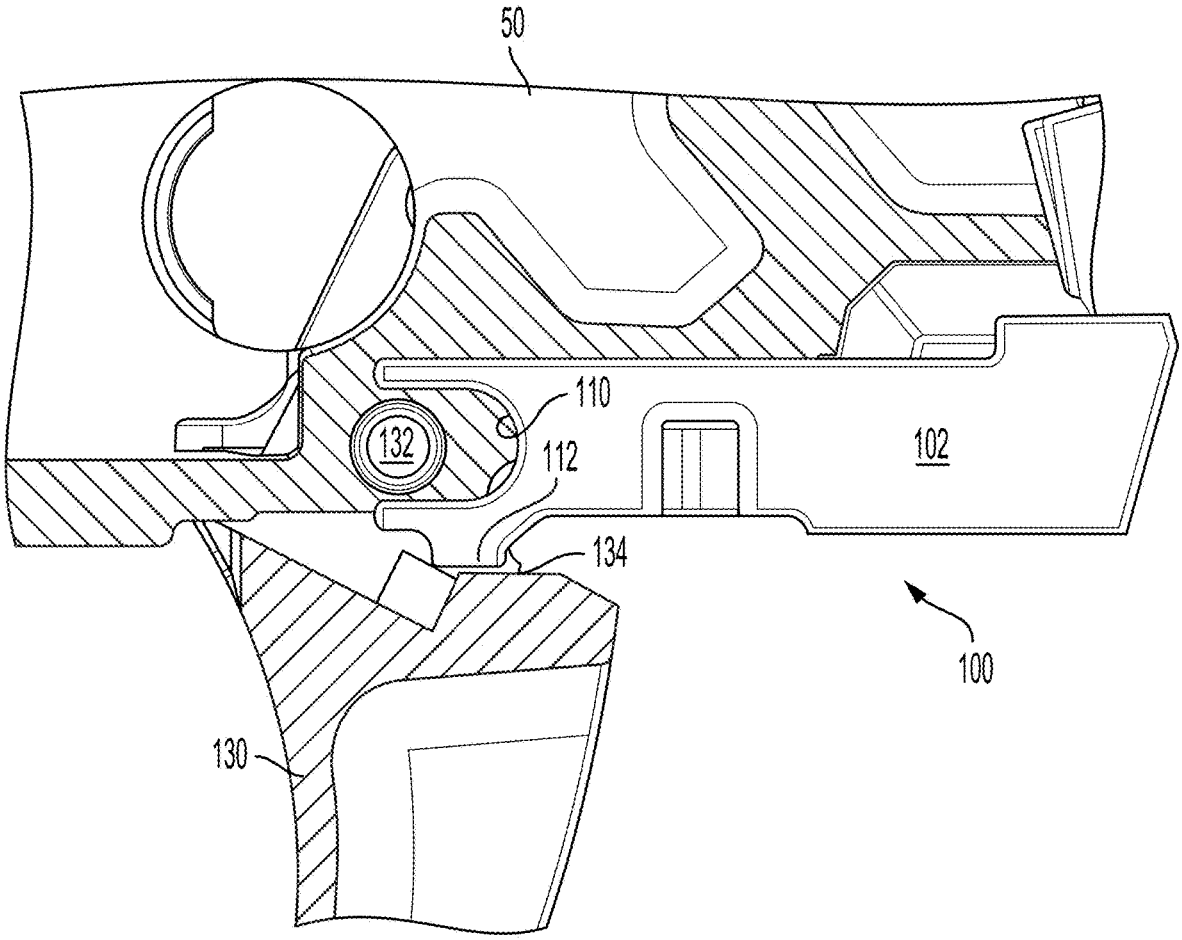
FIG. 3 illustrates a side view showing part of a receiver, trigger, and a magazine disconnect mechanism with a trigger block in a blocking position, in accordance with an embodiment of the present disclosure.

FIG. 3 illustrates a side view showing a longitudinal section of a receiver 50, and also shows part of a trigger 130 and magazine disconnect mechanism 100, in accordance with an embodiment of the present disclosure. In this example, the trigger block 102 is in a blocking position as indicated in FIG. 3A, for example, by the axial space between the trigger pin 132 and a pin slot 110 at the distal end of the trigger block 102. As can also be seen, in this blocking position the bottom of the trigger block 102 interferes with the trigger 130. In more detail, a shelf 112 on the bottom of the trigger block 102 is positioned to contact the trigger 130 on an upward-facing surface 134 near the trigger pin 132.

Figure 4A:
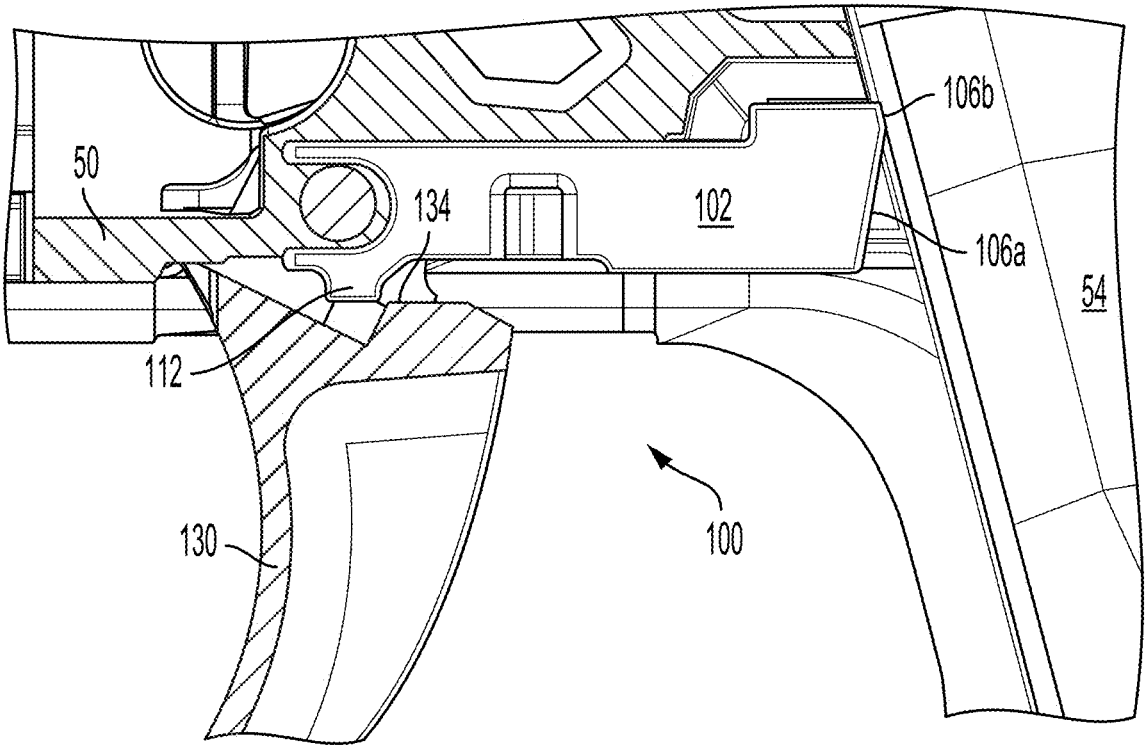
FIGS. 4A and 4B illustrate a side view of a longitudinal section showing a trigger in a resting position and a pulled position, respectively, and a magazine disconnect mechanism in a non-blocking position, in accordance with an embodiment of the present disclosure.
Figure 4B:
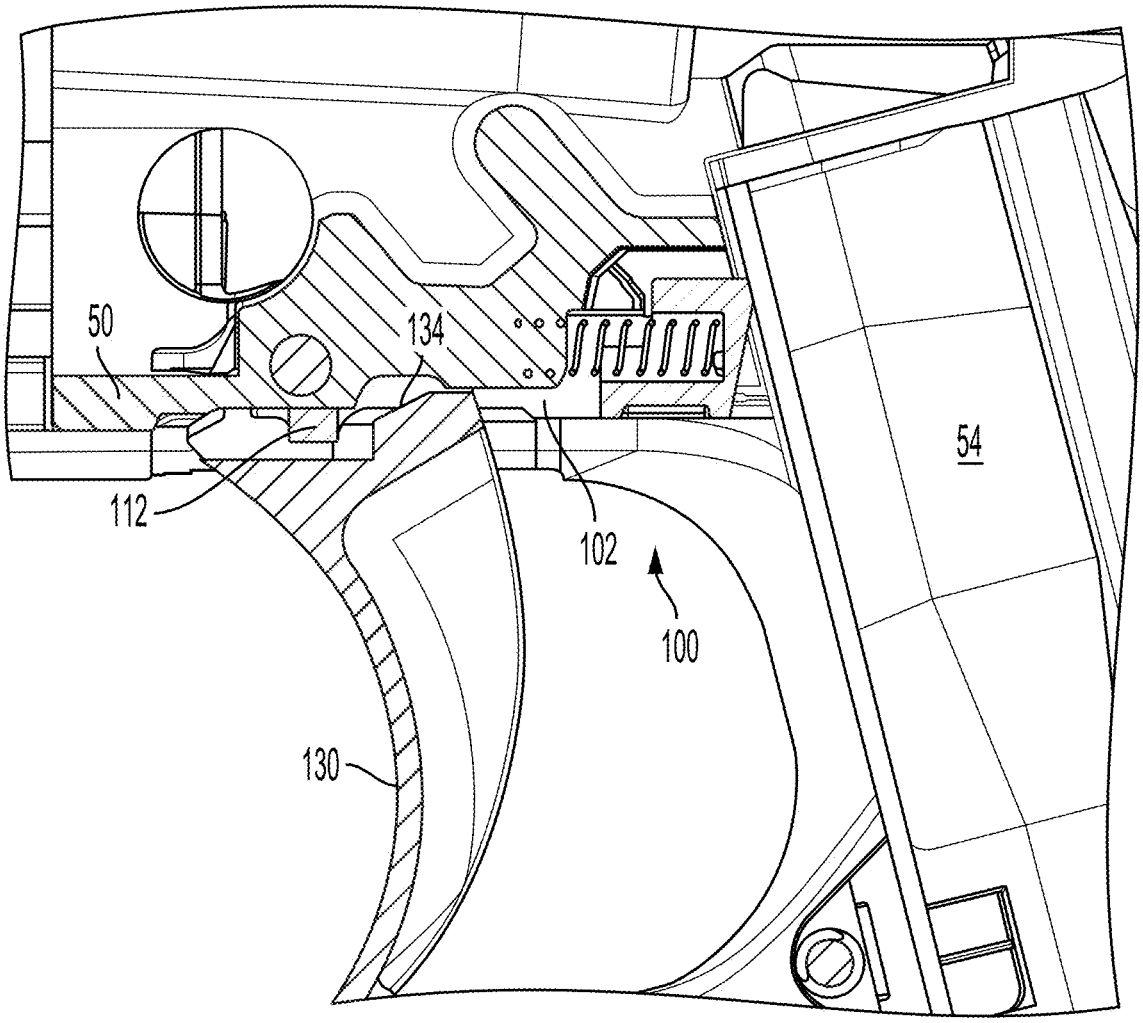

FIGS. 4A and 4B illustrate side views showing part of a receiver 50 with a magazine 54 installed in the magazine well and a magazine disconnect mechanism 100 with the trigger block 102 in a non-blocking position with respect to the trigger 130, in accordance with an embodiment of the present disclosure. In FIG. 4A, the trigger 130 is in the resting position; in FIG. 4B, the trigger 130 is in a pulled position. Note that compared to the position shown in FIG. 3, the trigger block 102 has shifted forward (to the left in FIG. 4A) due to contact between the magazine 54 and the second contact surface 106*b* of the trigger block 10. That is, as the magazine 54 is installed in the magazine well 60, the front wall of the magazine 54 contacts the first contact surface 106*a*, causing the trigger block 102 to translate forward, followed by the trigger block 102 remaining in contact with the magazine 54 at the second contact surface 106*b* as the magazine 54 is installed past this position. As shown in FIG. 4B, the spring 104 between the receiver 50 and the inside of the trigger block 102 biases the trigger block 102 into contact with the installed magazine 54. In the non-blocking position, the bottom surface or shelf 112 on the trigger block is out of alignment with the upward facing surface 134 on the trigger, therefore allowing the trigger to rotate to the pulled position, such as shown in FIG. 4B.

Figure 5A:
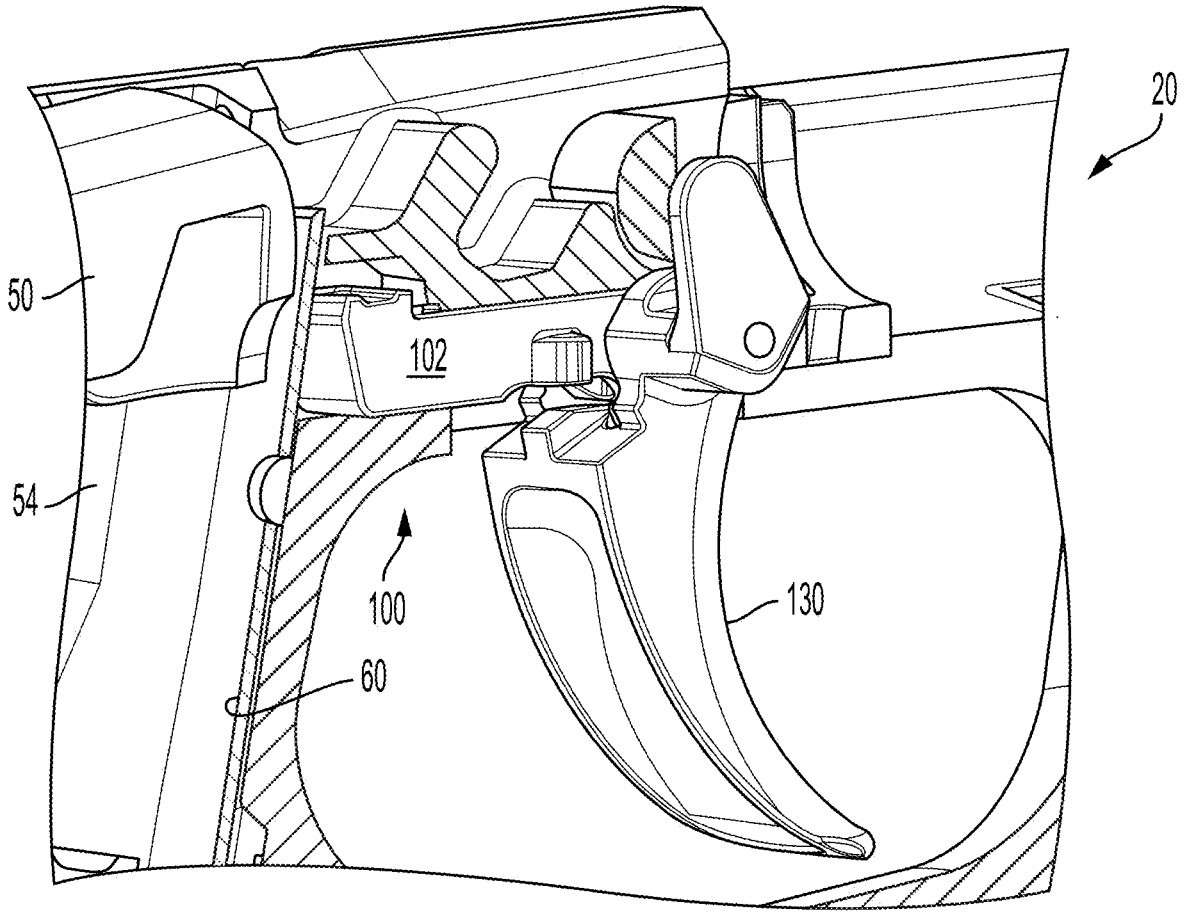
FIG. 5A illustrates a rear perspective view of a longitudinal section of part of a handgun showing a magazine installed in the magazine well, the magazine disconnect mechanism in a non-blocking position, and the trigger in a resting position, in accordance with an embodiment of the present disclosure.
Figure 5B:
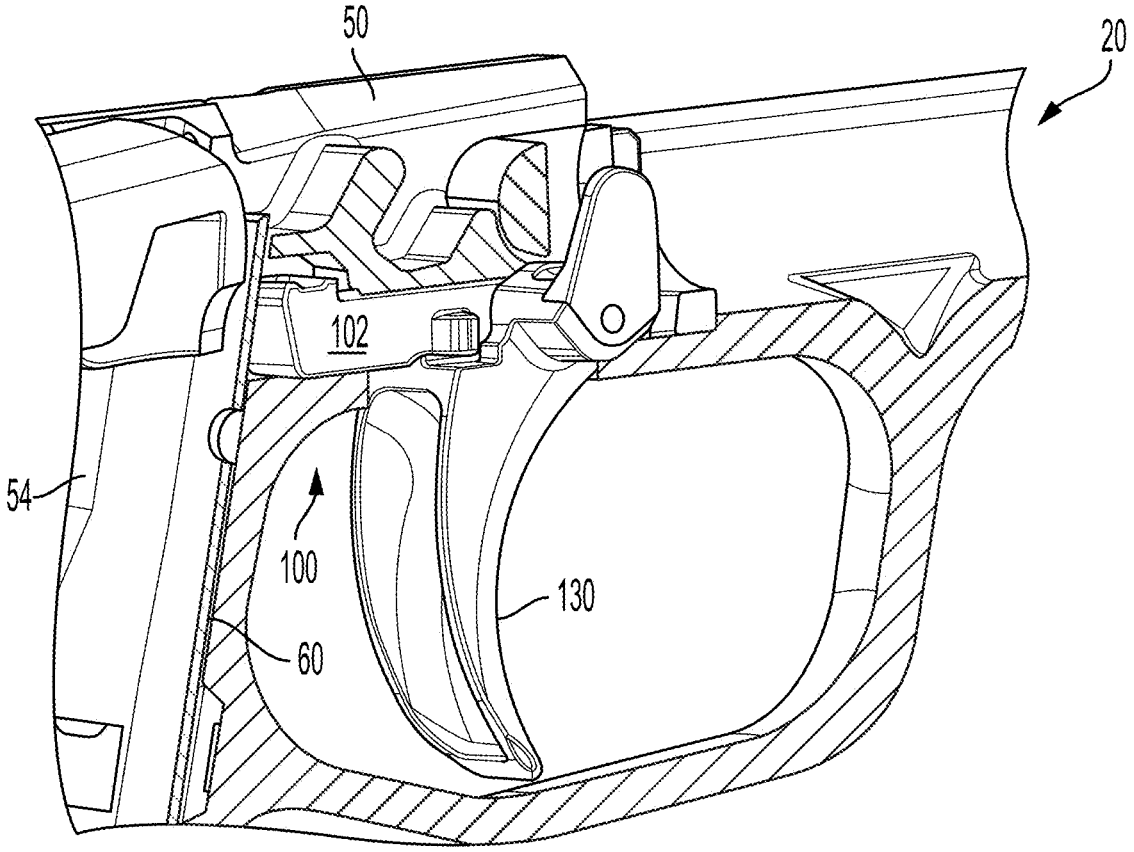
FIG. 5B illustrates a rear perspective view of the longitudinal section of FIG. 5A showing the trigger in a pulled position, in accordance with an embodiment of the present disclosure.

FIG. 5A illustrates a rear perspective and partial sectional view showing part of a handgun 20 with a magazine 54 installed in the magazine well 60, the trigger block 102 of the magazine disconnect mechanism 100 in a non-blocking position, and the trigger 130 in a resting position, in accordance with an embodiment of the present disclosure. FIG. 5B illustrates the rear perspective view of FIG. 5A showing the trigger 130 in a pulled position. Owing to the magazine 54 being seated in the magazine well 60, the trigger block 102 has been shifted forward to the non-blocking position, allowing the trigger 130 to be pulled, such as shown in FIG. 5B.

Figure 6:
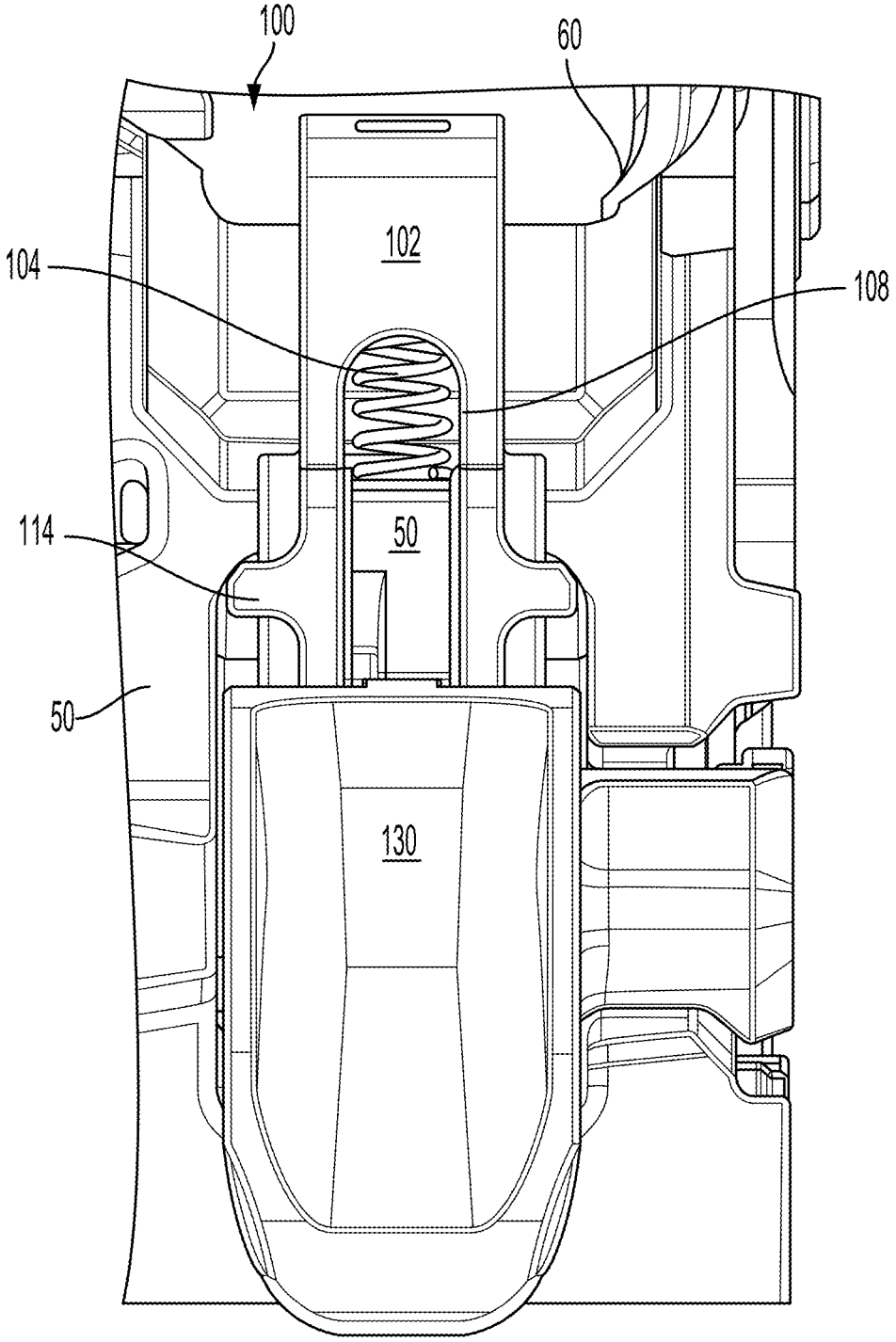
FIG. 6 illustrates a bottom view showing a trigger and a magazine disconnect mechanism, where the magazine disconnect mechanism is in a blocking position, in accordance with an embodiment of the present disclosure.

FIG. 6 illustrates a bottom view showing part of a receiver 50, a trigger 130, and a magazine disconnect mechanism 100, where the trigger block 102 of the magazine disconnect mechanism 100 is in a blocking position, in accordance with an embodiment of the present disclosure. In the blocking position as shown here, a rear end 104 of the trigger block 102 extends into the magazine well 60 due to bias force of the spring 104 between the trigger block 102 and the receiver 50. Part of the receiver 50 is received in the channel 108 defined in the trigger block 102. The trigger block 102 has one or more protrusions 114 that limit its axial travel. In this example, the trigger block 102 has two protrusions 114, each of which extends laterally from the body of the trigger block 102. The protrusions 114 contact part of the receiver 50 as the trigger block 102 travels rearward to the blocking position, retaining the trigger block 102 in the receiver 102. In this example, the protrusions 114 are positioned at approximately a middle of the trigger block 102, but the protrusion(s) 114 can be positioned in other locations and can extend in other directions, such as vertically. Additionally, the protrusion(s) 114 can be structured as a flange, tab, shelf, or other geometry as deemed suitable for use in a particular receiver. Numerous variations and embodiments will be apparent in light of the present disclosure.

Figure 7:
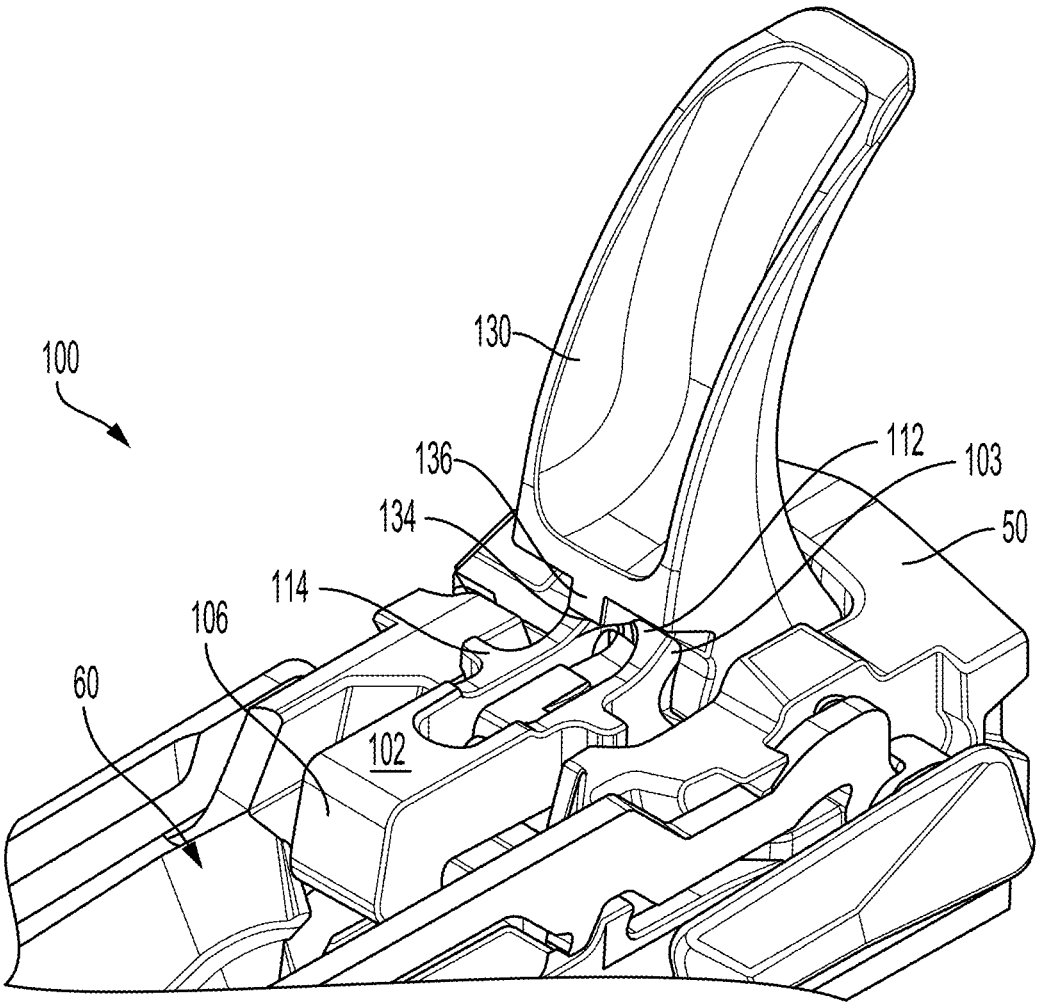
FIG. 7 illustrates a bottom perspective view showing the trigger and magazine disconnect mechanism of FIG. 6.

FIG. 7 illustrates a bottom perspective view showing the trigger and magazine disconnect mechanism of FIG. 6. Part of the receiver 50 is received in the channel 108 of the trigger block 102, which is in the blocking position with protrusions 114 in contact with the receiver 50 and the rear end 106 extending into the magazine well 60. The distal end portion 103 or shelf 112 of the trigger block 102 interferes with pulling the trigger 130 by obstructing or making contact with one or more of the upward facing surfaces 134 on the trigger 130 during a trigger pull, such as the upward facing surface 134 of tongue 136.

Figure 8:
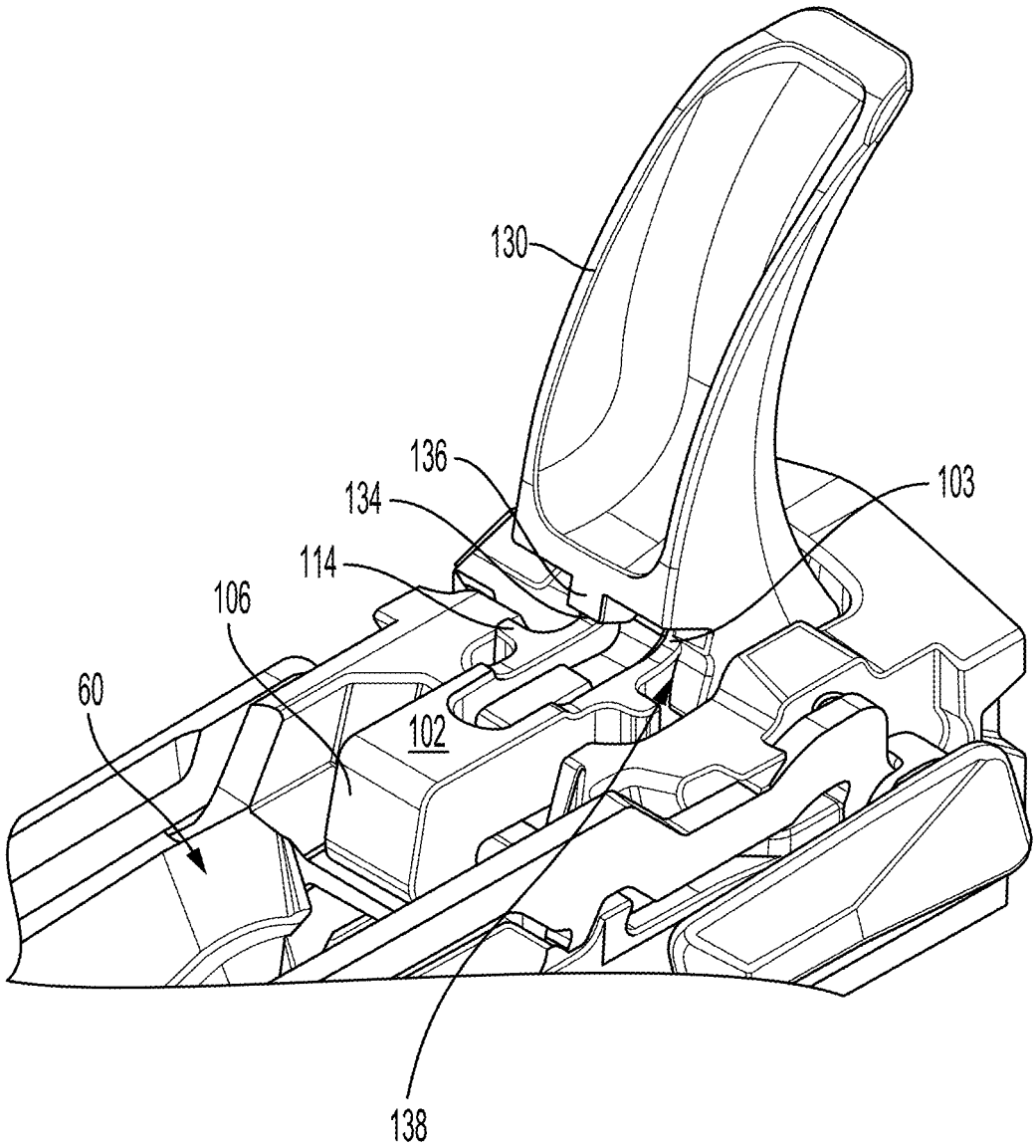
FIG. 8 illustrates a bottom perspective view showing the trigger and magazine disconnect mechanism, where the magazine disconnect mechanism is in a non-blocking position, in accordance with an embodiment of the present disclosure.

FIG. 8 illustrates a bottom perspective view showing the receiver 50 of FIG. 7, where the trigger block 102 of the magazine disconnect mechanism 100 is in a non-blocking position, in accordance with an embodiment of the present disclosure. To more clearly show components of the magazine disconnect 100, no magazine 54 is shown in this figure. As discussed above, however, when a magazine 54 is present in the magazine well 60, it would make contact with the rear end 106 of the trigger block 102 to shift the trigger block 102 forward and to maintain its forward non-blocking position. It should be noted that a magazine 54 is not the only to actuate the trigger block 102 and the trigger block 102 can be moved manually to the non-blocking position, such as using one's finger or a tool to illustrate operation of the device, for example. Note that in the non-blocking position as shown here, the distal end portion 103 of the trigger block 102 has moved forward into a cavity or slot 138 defined by the trigger 130, resulting in clearance for an upward facing surface 134 (e.g., block 136) and therefore allowing the trigger 130 to pivot to the pulled position.

Figure 9A:
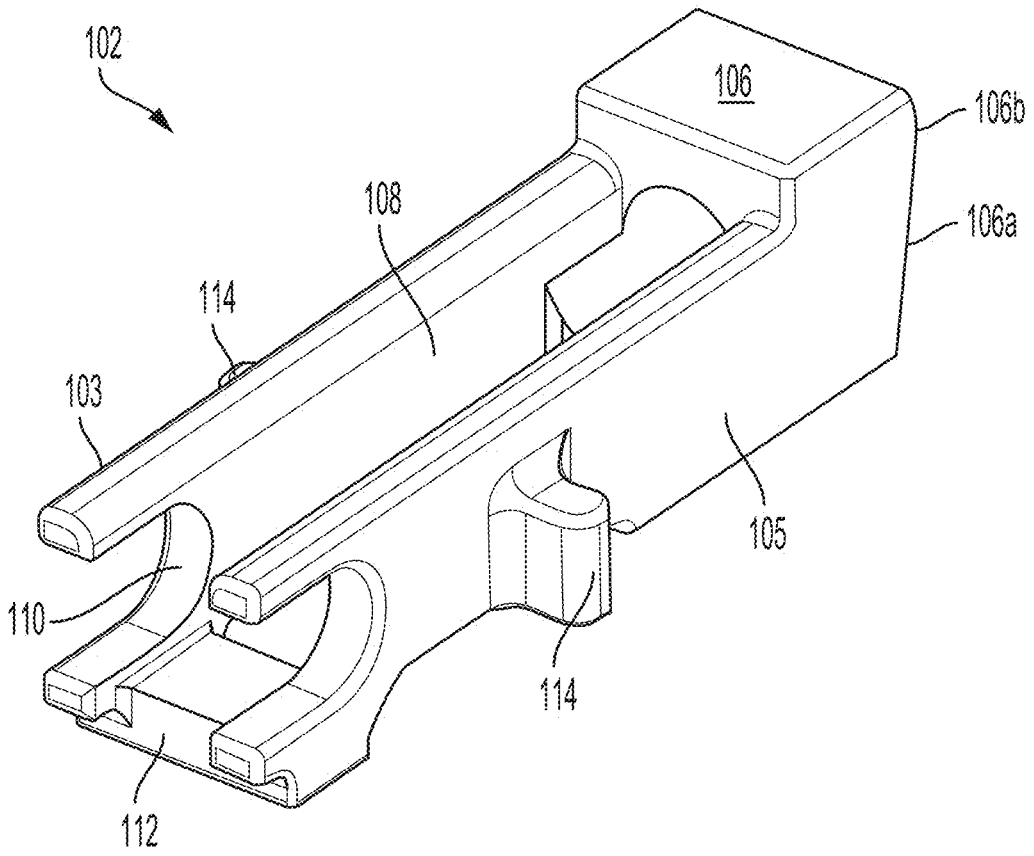
FIGS. 9A-9D illustrate various views of a trigger block, in accordance with an embodiment of the present disclosure.
Figure 9B:
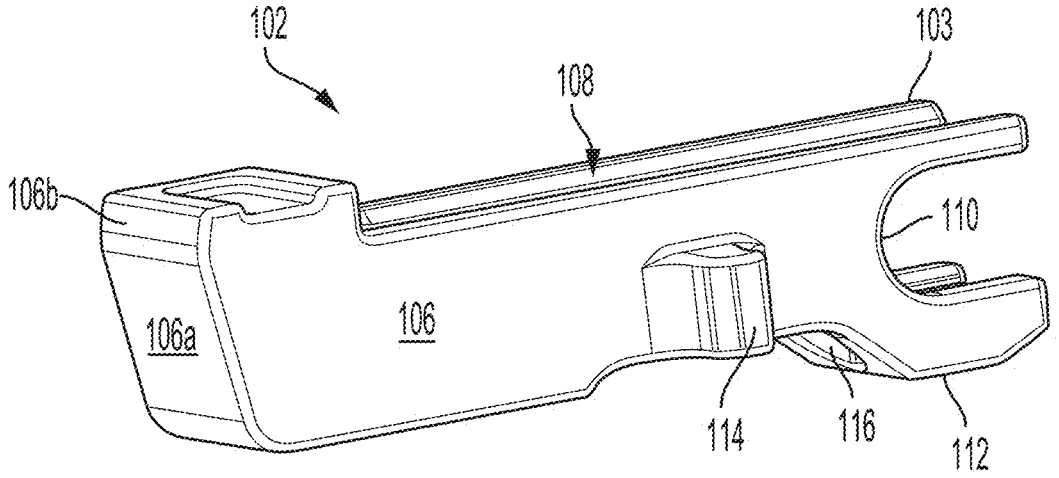
Figure 9C:
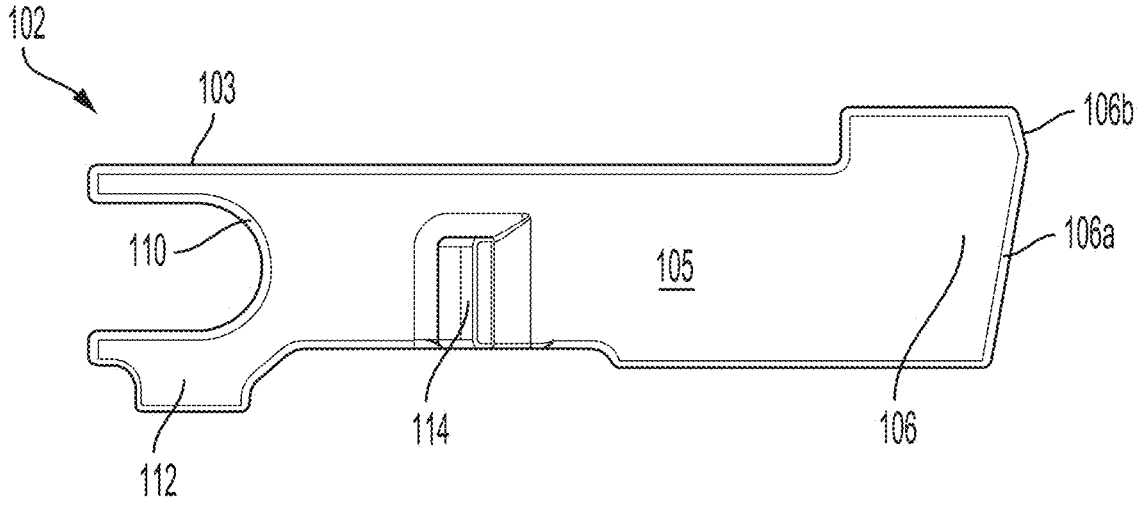
Figure 9D:
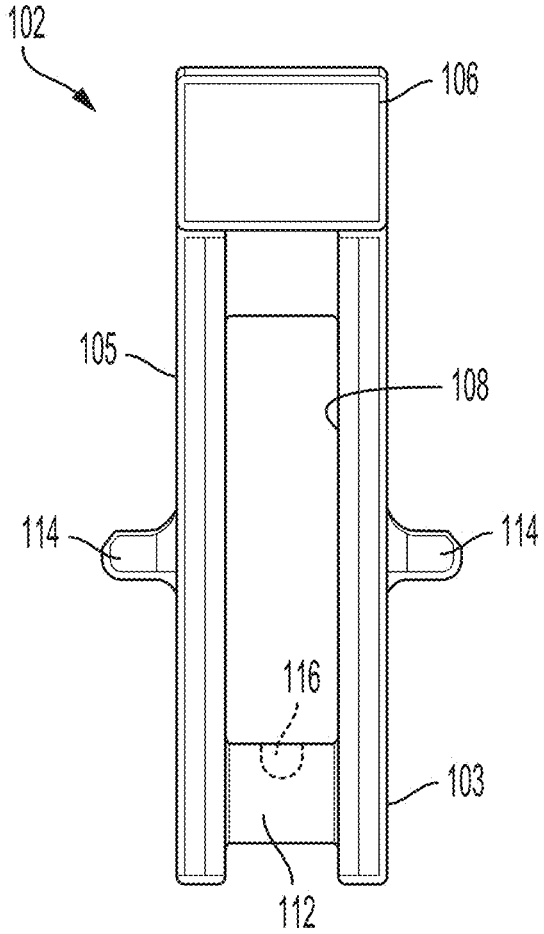

FIGS. 9A-9D illustrate various views of a trigger block, in accordance with an embodiment of the present disclosure. FIG. 9A is a front perspective view, FIG. 9B is a side and rear perspective view, FIG. 9C is a side view, and FIG. 9D is a top view. The trigger block 102 extends longitudinally from a rear end 106 to a distal end portion 103 that defines a pin slot 110. The distal end portion 103 includes shelf 112, which extends laterally across a bottom portion of the distal end portion 103 in this example. Protrusions 114 extend laterally away from the body 105. The body 105 defines a channel 108 to house the spring 104 (shown in FIGS. 1-2). The rear end 106 has first contact surface **106*a* and second contact surface 106*b*, each of which is planar in this example. In other embodiments, the rear end 106** can define one or more contact surfaces that is/are planar or curved, for example.

As can be seen in FIG. 9B, the distal end portion 103 defines a void or opening 116 adjacent the shelf 112. The void or opening 116 is sized and arranged to receive the tongue 136 of the trigger 130 when the trigger is pulled. Other combinations of structures can be used to define clearance and interference conditions with the trigger 130.

Figure 10A:
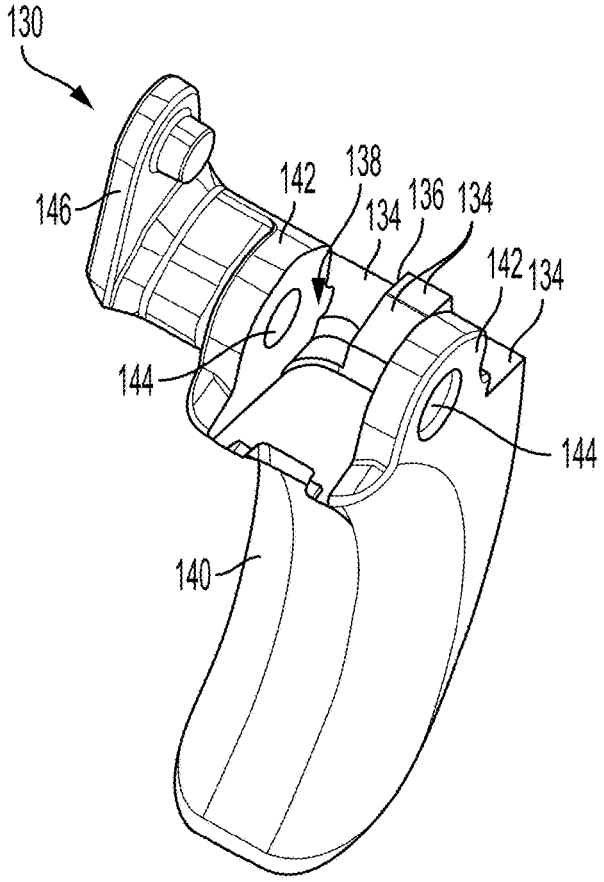
FIGS. 10A-10C illustrate various views of a handgun trigger, in accordance with an embodiment of the present disclosure.
Figure 10B:
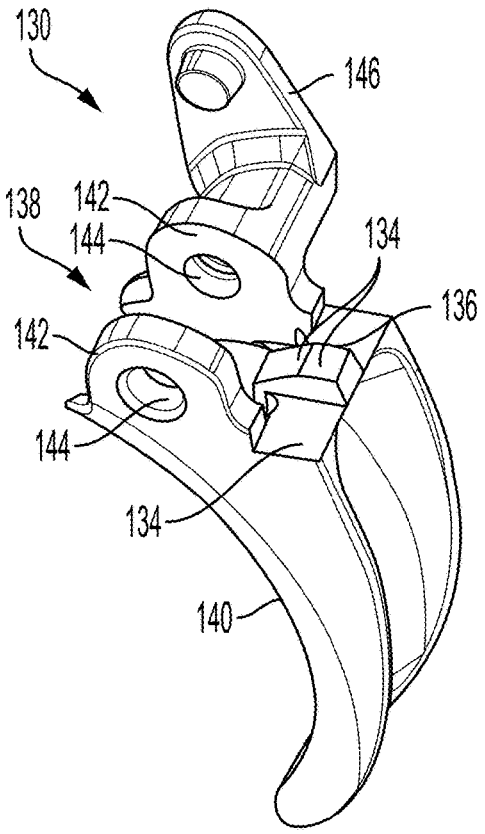
Figure 10C:
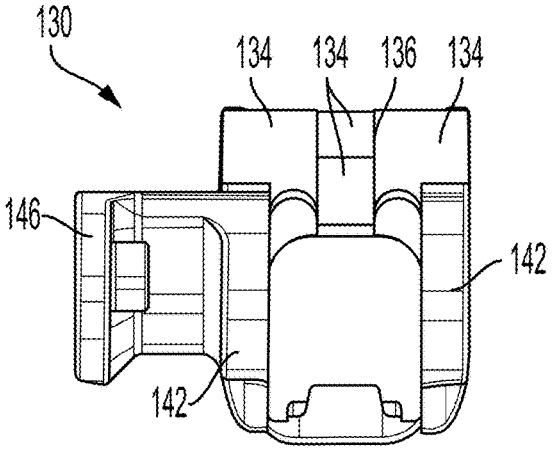

FIGS. 10A-10C illustrate various views of a handgun trigger 130, in accordance with an embodiment of the present disclosure. FIG. 10A is a top, front, and side perspective view; FIG. 10B is a top, side, and rear perspective view; and FIG. 10C is a top view. Trigger 130 includes a trigger body 140 configured for manipulation by the user. In this example, the trigger 140 is monolithic with the remainder of the trigger 130 and has a curved geometry. The trigger 130 can have other configurations, such as a straight trigger body or a removable trigger shoe. Knuckles 142 extend up from opposite lateral sides of the trigger body 140, where each knuckle 142 defines a pin opening 144 for the trigger pin 1323 (shown in FIGS. 1-2). Knuckles 142 are spaced laterally to define a cavity or slot 138 between them. A tongue 136 protrudes upward from a top or upward facing surface 134 of the trigger body 140 and includes one or more additional upward facing surfaces 134, one or both of which may interact with the trigger block 102 when the trigger block 102 is in the blocking position. An actuation arm 146 connects to one of the knuckles 142 and is configured to operate a trigger bar, for example.

FIG. 11 illustrates a side view showing a longitudinal section of a handgun 20 with a magazine disconnect mechanism 100, where the trigger 130 is at rest and a magazine 54 is installed in the magazine well 60, in accordance with an embodiment of the present disclosure. Since the magazine 54 is installed in the magazine well 60, the rear end 106 of the trigger block 102 engages the magazine 54, causing the trigger block 102 to occupy the non-blocking or forward position. The shelf 112 of the trigger block 102 is in a clearance position, allowing the trigger 130 to be pulled.

Figure 12:
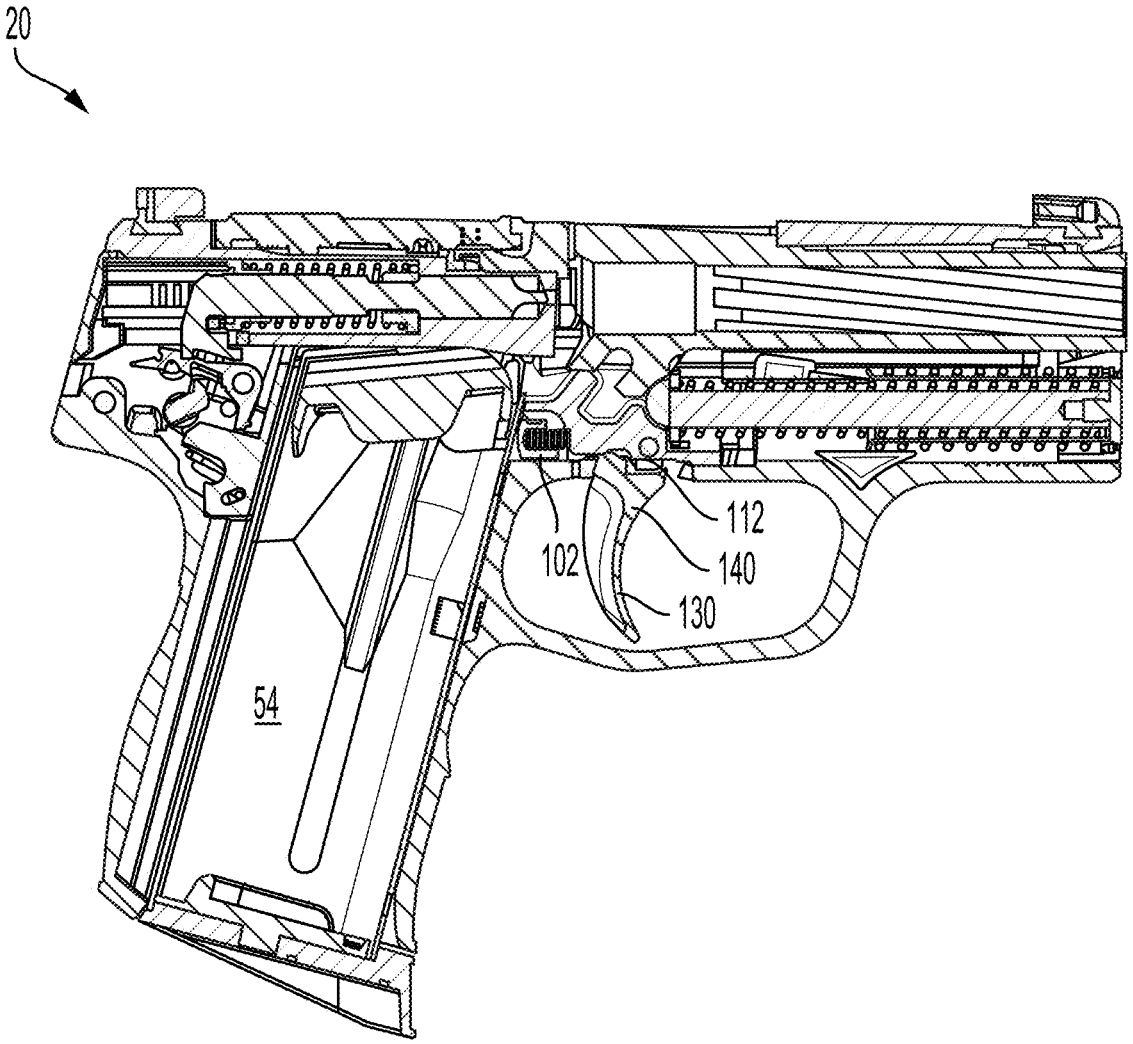
FIG. 12 illustrates a side view showing the longitudinal section of FIG. 11, where the trigger is in a pulled position, in accordance with an embodiment of the present disclosure.

FIG. 12 illustrates a side view showing the longitudinal section of FIG. 11, where the trigger 130 is in a pulled position, in accordance with an embodiment of the present disclosure. In the pulled trigger position, the top of the trigger body 140 clears the bottom portion or shelf 112 of the trigger block 102.

Figure 13:
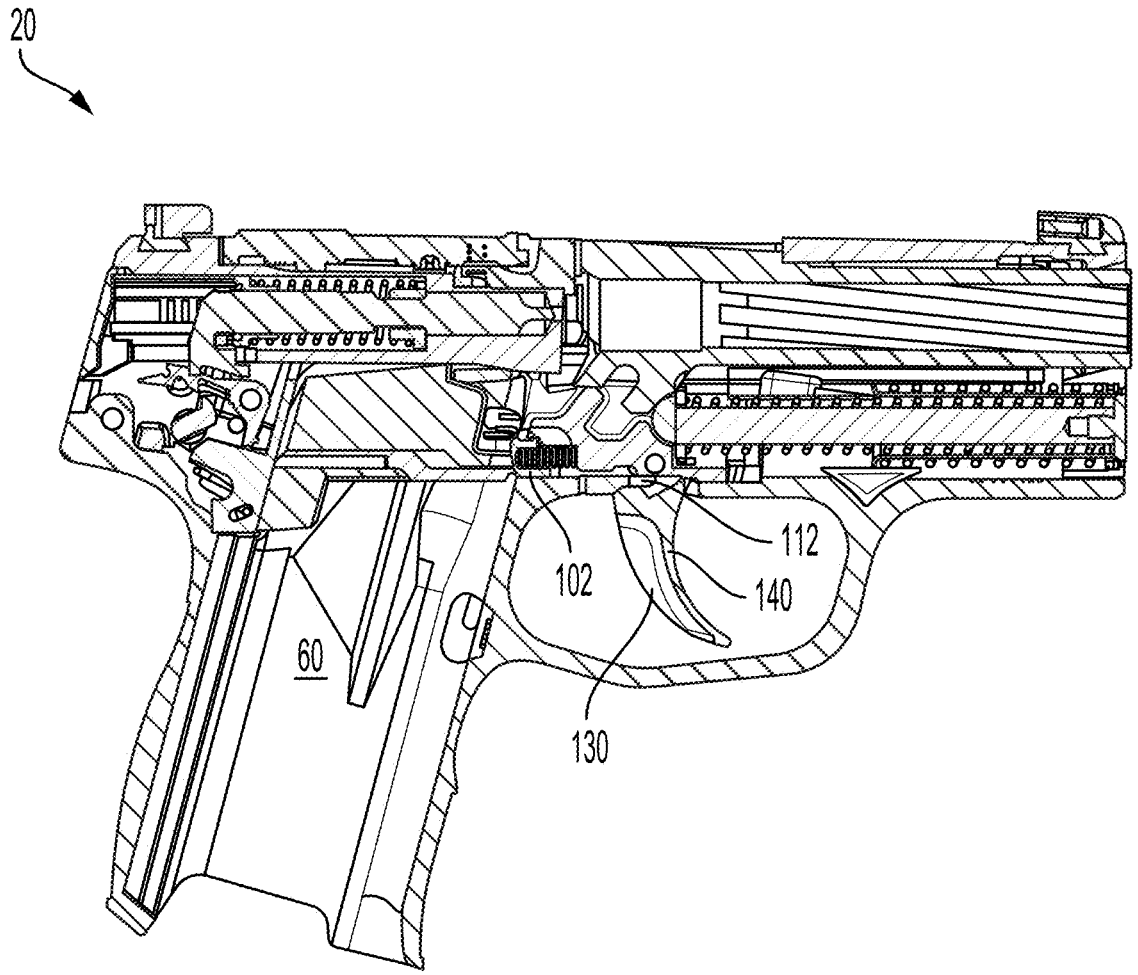
FIG. 13 illustrates a side view showing a longitudinal section of a handgun with a magazine disconnect mechanism, where no magazine is present in the magazine well, in accordance with an embodiment of the present disclosure.

FIG. 13 illustrates a side view showing a longitudinal section of the handgun 20 with a magazine disconnect mechanism 100, where no magazine is present in the magazine well 60, in accordance with an embodiment of the present disclosure. Without a magazine in the magazine well 60, the trigger block 102 has shifted rearward to assume the blocking position in which the bottom portion or shelf 112 of the trigger block 102 interferes with the trigger body 140, thereby blocking the trigger 130 from being pulled.

FURTHER EXAMPLE EMBODIMENTS

The following examples pertain to further embodiments, from which numerous permutations and configurations will be apparent.

Example 1 is a firearm defining a magazine well configured to receive a magazine. A trigger is operable between a resting position and a pulled position. A magazine disconnect mechanism has a trigger block positioned between the trigger and the magazine well, where the trigger block is movable from a blocking position to a non-blocking position in response to the magazine well receiving the magazine. The trigger block is in the blocking position when the magazine is absent from the magazine well such that the trigger block obstructs moving the trigger to the pulled position. The magazine well can be defined in a grip portion of the firearm.

Example 2 includes the firearm of Example 1 and includes a grip module defining the magazine well, and a receiver installed in the grip module, where the trigger is pivotably mounted to the receiver. A spring is between the trigger block and the receiver and biases the trigger block towards the blocking position.

Example 3 includes the firearm of Example 2, where the trigger block defines a channel and where the spring is received in the channel.

Example 4 includes the firearm of Example 3, where part of the receiver occupies the channel and where the spring is between the trigger block and the part of the receiver occupying the channel.

Example 5 includes the firearm of any one of Examples 1-4, where the trigger block is configured to move along a bore axis of the firearm between the blocking position and the non-blocking position.

Example 6 includes the firearm of Example 2, where the trigger block includes a body with one or more protrusions extending laterally from the body, and where in the blocking position the one or more protrusions engage the receiver.

Example 7 includes the firearm of any one of Examples 1-6, where the trigger block has a body with spaced-apart walls extending longitudinally and defining the channel. A shelf on a distal end portion of the body extends laterally between and connects the spaced-apart walls. The shelf is arranged to contact the trigger during an attempted trigger pull when the trigger block is in the blocking position.

Example 8 includes the firearm of any one of Examples 1-7, where in the blocking position an upward facing surface of the trigger contacts the trigger block during an attempted trigger pull, thereby preventing the trigger from moving to the pulled position.

Example 9 includes the firearm of Example 8, where the upward facing surface contacts a bottom of the trigger block during the attempted trigger pull.

Example 10 includes the firearm of any one of Examples 1-9, where the trigger has a trigger shoe and knuckles extending upward above the trigger shoe, the knuckles spaced laterally by a gap and each of the knuckles defining a trigger pin opening, and where the trigger block is received in the gap at least in the blocking position.

Example 11 includes the firearm of Example 10 and includes a trigger pin extending through the pin openings of the knuckles, and where the front-end portion of the trigger block defines a pin slot configured and arranged to receive the trigger pin at least when the trigger block is in the non-blocking position.

Example 12 includes the firearm of any one of Examples 1-11, where the trigger block extends longitudinally between a rear end and a front-end, the rear end defining one or more contact surfaces configured to contact a magazine when the magazine is installed in the magazine well.

Example 13 includes the firearm of any one of Examples 1-12, where part of the trigger block is in the magazine well when the trigger block is in the blocking position.

Example 14 includes the firearm of any one of Examples 1-13, where the blocking position is a rearward position of the trigger block and the non-blocking position is a forward position of the trigger block.

Example 15 includes the firearm of any one of Examples 1-14, where the firearm is configured as a semiautomatic handgun.

Example 16 includes the firearm of Example 15, where the firearm is a striker-fired handgun.

Example 17 is a handgun comprising a grip module defining a magazine well, a trigger operable between a resting position and a pulled position, and a trigger block positioned between the trigger and the magazine well. The trigger block is movable from a blocking position to a non-blocking position in response to installing a magazine in the magazine well. In the blocking position the trigger block obstructs moving the trigger to the pulled position. The trigger block is spring-biased toward the blocking position and the trigger block occupies the blocking position when the magazine is absent from the magazine well.

Example 18 includes the handgun of Example 17 and includes a receiver installed in the grip module, where the trigger is movably attached to the receiver.

Example 19 includes the handgun of Example 17 or 18, where the trigger block moves longitudinally between the blocking position and the non-blocking position.

Example 20 includes the handgun of any one of Examples 17-19, where the trigger block is arranged to contact a top of the trigger shoe when the trigger block is in the blocking position.

Example 21 includes the handgun of any one of Examples 17-20, where the trigger block defines a channel and includes a spring in the channel.

Example 22 includes the handgun of Example 18, where the trigger block defines a channel and includes a spring in the channel between the trigger block and the receiver.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

The invention claimed is:

1. A firearm comprising:

a grip module defining a magazine well configured to receive a magazine;

a receiver installed in the grip module;

a trigger pivotably mounted to the receiver and operable between a resting position and a pulled position;

a magazine disconnect mechanism having a trigger block positioned between the trigger and the magazine well, the trigger block movable from a blocking position to a non-blocking position in response to the magazine well receiving the magazine, wherein the trigger block defines a channel and wherein part of the receiver occupies the channel; and a spring in the channel and positioned between the trigger block and part of the receiver in the channel, wherein the spring biases the trigger block towards the blocking position;

wherein the trigger block is in the blocking position when the magazine is absent from the magazine well such that the trigger block obstructs moving the trigger to the pulled position.

2. The firearm of claim 1, wherein the trigger block is configured to move along a bore axis of the firearm between the blocking position and the non-blocking position.

3. The firearm of claim 2, wherein the trigger block includes a body with one or more protrusions extending laterally from the body, wherein the one or more protrusions are arranged to engage the receiver to limit axial travel of the trigger block.

4. The firearm of claim 1, wherein the trigger block comprises:

a body with spaced-apart walls extending longitudinally and defining the channel;

a shelf on a distal end portion of the body, the shelf extending laterally between and connecting the spaced-apart walls, wherein the shelf is arranged to contact the trigger during an attempted trigger pull when the trigger block is in the blocking position.

5. The firearm of claim 1, wherein in the blocking position an upward facing surface of the trigger contacts the trigger block during an attempted trigger pull, thereby preventing the trigger from moving to the pulled position.

6. The firearm of claim 5, wherein the upward facing surface contacts a bottom of the trigger block during the attempted trigger pull.

7. The firearm of claim 1, wherein the trigger has a trigger shoe and knuckles extending upward above the trigger shoe, the knuckles spaced laterally by a gap and each of the knuckles defining a trigger pin opening, and wherein the trigger block is received in the gap at least in the blocking position.

8. The firearm of claim 7, comprising:

a trigger pin extending through the pin openings of the knuckles;

wherein the front-end portion of the trigger block defines a pin slot configured and arranged to receive the trigger pin at least when the trigger block is in the non-blocking position.

9. The firearm of claim 1, wherein the trigger block extends longitudinally between a rear end and a front-end, the rear end defining one or more contact surfaces configured to contact a magazine when the magazine is received in the magazine well.

10. The firearm of claim 1, wherein part of the trigger block is in the magazine well when the trigger block is in the blocking position.

11. The firearm of claim 1, wherein the blocking position is a rearward position of the trigger block and the non-blocking position is a forward position of the trigger block.

12. The firearm of claim 1, wherein the firearm is configured as a semiautomatic handgun.

13. The firearm of claim 12, wherein the firearm is a striker-fired handgun.

14. The firearm of claim 1, comprising a trigger pin extending crosswise through the trigger, wherein the trigger pin limits travel of the trigger block in at least one direction.

15. The firearm of claim 1, wherein a rear portion of the trigger is arranged to contact the trigger block when the trigger block is in the blocking position.

16. A handgun receiver configured to be installed in a handgun grip module and defining part of a magazine well, the receiver comprising:

a trigger pivotably mounted to the receiver and operable between a resting position and a pulled position;

a trigger block positioned between the trigger and the magazine well, the trigger block movable from a blocking position to a non-blocking position in response to installing a magazine in the magazine well, wherein the trigger block defines a channel and wherein part of the receiver occupies the channel; and a spring in the channel and positioned between the trigger block and the part of the receiver in the channel, wherein the spring biases the trigger block towards the blocking position;

wherein in the blocking position the trigger block obstructs moving the trigger to the pulled position.

17. The handgun of claim 16, wherein the trigger block moves longitudinally between the blocking position and the non-blocking position.

18. The handgun receiver of claim 17, comprising a trigger pin extending crosswise through the trigger, wherein the trigger pin limits travel of the trigger block in at least one direction.

19. The handgun receiver of claim 17, wherein the trigger block includes a body with one or more protrusions extending laterally from the body, wherein the one or more protrusions are arranged to engage the receiver to limit longitudinal travel of the trigger block.

20. The handgun receiver of claim 16, wherein a rear portion of the trigger is arranged to contact the trigger block when the trigger block is in the blocking position.

* * * * *